US011920099B2

(12) United States Patent
Al-Hashmy

(10) Patent No.: US 11,920,099 B2
(45) Date of Patent: Mar. 5, 2024

(54) EXTRUDER SYSTEMS AND PROCESSES FOR PRODUCTION OF PETROLEUM COKE

(71) Applicant: Saudi Arabian Oil Company, Dhahran (SA)

(72) Inventor: Hasan Ali Al-Hashmy, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/534,165

(22) Filed: Nov. 23, 2021

(65) Prior Publication Data

US 2023/0159839 A1 May 25, 2023

(51) Int. Cl.
*C10L 5/08* (2006.01)

(52) U.S. Cl.
CPC ..... *C10L 5/08* (2013.01); *C10L 2290/28* (2013.01); *C10L 2290/32* (2013.01)

(58) Field of Classification Search
CPC ..... C10L 5/08; C10L 2290/28; C10L 2290/32
See application file for complete search history.

(56) References Cited

U.S. PATENT DOCUMENTS 3,787,541 A * 1/1974 Grindstaff et al. ..... C01B 32/00 423/448
4,206,713 A 6/1980 Ryason
4,216,074 A * 8/1980 Simone ..... C10G 1/006 208/418
4,302,324 A 11/1981 Chen et al.
4,584,060 A * 4/1986 Winckler ..... C10B 7/10 201/35
4,891,203 A 1/1990 Singer et al.
5,200,061 A 4/1993 Viscontini
5,655,835 A * 8/1997 Pham ..... B29C 48/53 366/89
8,444,828 B2 5/2013 Wolfe
9,732,278 B2 8/2017 Kawachi et al.
2020/0299586 A1* 9/2020 Atkins ..... D01F 9/322
2020/0299588 A1 9/2020 Goodrich et al.

FOREIGN PATENT DOCUMENTS

CN 212687968 U 3/2021
EP 0250136 B1 2/1992
GB 753084 A 7/1956
JP 2002178388 A * 6/2002 ..... B29C 47/822

* cited by examiner

*Primary Examiner* — Latosha Hines
(74) *Attorney, Agent, or Firm* — Bracewell LLP; Constance G. Rhebergen; Eleanor T. Porter

(57) ABSTRACT

Systems and methods for production for consistently sized and shaped petroleum coke from vacuum residue, one method including supplying processed vacuum residue to an extruder; heating the processed vacuum residue throughout a horizontal profile of the extruder from an inlet to an outlet of the extruder; venting hydrocarbon off-gases from the extruder along the horizontal profile of the extruder from the inlet to the outlet of the extruder; and cutting consistently sized and shaped petroleum coke at the outlet of the extruder.

10 Claims, 2 Drawing Sheets

EXTRUDER SYSTEMS AND PROCESSES FOR PRODUCTION OF PETROLEUM COKE

BACKGROUND

Field

The present disclosure relates generally to the production of petroleum coke in oil refining systems and processes. Specifically, the disclosure relates to the use of extruder systems and processes for the direct production of petroleum coke from vacuum residue in a coker fractionator.

Description of the Related Art

Traditionally, heavy vacuum residue produced in oil refining process, such as during vacuum distillation, is sent to delayed coker systems and processes in order to produce a petroleum coke product. For example, vacuum residue from a refining process is sent to a delayed coker stage (described further with regard to FIG. 1) where the vacuum residue is treated at high temperature (about 900° F. to 950° F.) and high pressure (about 15 psig to 90 psig) to produce gases such as fuel gas and liquid propane gas (LPG), coker naphtha, coker gas oils such as light coker gas oil (LCGO) and heavy coker gas oil (HCGO), and petroleum coke.

A delayed coker system or process includes a type of coker which heats a residual oil feed to its thermal cracking temperature in a furnace with multiple parallel passes. This cracks the heavy, long chain hydrocarbon molecules of the residual oil into coker gas oils and petroleum coke. However, these products exhibit market prices that can barely cover the process expenses. Maximizing the consistency and efficiency of coker systems and processes is therefore necessary.

Prior art systems and methods include various means for producing petroleum cokes through traditional delayed coker units. However, prior art systems and methods are inefficient and inconsistent at providing useful petroleum coke, for example as a usable product for carbon fiber manufacture from pitches, including mesophase pitch.

SUMMARY

Embodiments disclosed herein provide extruder systems and processes capable of directly producing petroleum coke from vacuum residue processed in a coker fractionator in a consistent and efficient manner compared to traditional delayed coker refining systems and processes. Petroleum coke is widely used by many industries such as steel manufacturing companies due to a high heating value, and carbon fiber manufacture companies use petroleum coke to produce pitch petroleum (such as mesophase pitch) and subsequent carbon fibers. Unique thermomechanical extruders of the present disclosure (for example regularly cylindrical and/or cone-shaped) enable substantial, surprising, and unexpected reduction in the cost of energy and in water consumption versus traditional delayed coker units, and disclosed systems and processes ensure controlled and consistent production (for example with regard to shape and size) of petroleum cokes.

Embodiments of systems and methods described here allow for the bottom product of vacuum distillation, which is produced at temperature between about 430° C. to about 450° C. and a pressure of about 0.1 kPa, to proceed through a coker fractionator and then direct thermomechanical extrusion, described further with regard to FIGS. 2 and 3. The vacuum residue product processed in one or more extruder is at an elevated temperature and a pressure, which allows the lighter products to be released from controlled venting tubes. In some embodiments, the temperature along a horizontal extruder profile is between about 350° C. (572° F.) to about 450° C. (842° F.). Pressure along the horizontal extruder profile can be between about 0.1 kPa to about 1 kPa. Heated and pressurized extrusion allows for the conversion of vacuum residue product into petroleum coke products. Two example designs of thermomechanical extruders are discussed, including a regular cylinder-shaped extruder and a cone-shaped extruder, which achieve elevated temperature and a pressure ensuring consistent petroleum coke products and maximizing the extraction of light gas products through different stages of venting. Temperature and pressure along the horizontal profile of one or more extrusion unit can be substantially consistent or varied for advantageous extraction of light gas products and production of consistently sized, shaped, and composed petroleum coke.

Consistent petroleum coke products produced here can be used to produce mesophase pitch for production of carbon fibers. Consistent size and shape of produced petroleum cokes is advantageous for distribution of heating capacity for certain end users, such as steel manufacturers.

Therefore, disclosed here are methods of production for consistently sized and shaped petroleum coke from vacuum residue, one method including supplying processed vacuum residue to an extruder; heating the processed vacuum residue throughout a horizontal profile of the extruder from an inlet to an outlet of the extruder; venting hydrocarbon off-gases from the extruder along the horizontal profile of the extruder from the inlet to the outlet of the extruder; and cutting consistently sized and shaped petroleum coke at the outlet of the extruder. In some embodiments, the method is carried out without the application of steam, hydrogen, or water. Certain embodiments include fractionating vacuum residue, produced in a vacuum distillation column at a temperature between about 430° C. to about 450° C. and a pressure of about 0.1 kPa, to remove liquid propane gas, fuel gas, coker naphtha, light coker gas oil, and heavy coker gas oil to produce the processed vacuum reside as a bottom product prior to the step of supplying. In some embodiments, the step of venting hydrocarbon off-gases from the extruder comprises recycling vented hydrocarbon off-gases to the step of fractionating.

Still in yet other embodiments, the step of venting is carried out in multiple stages along the horizontal profile of the extruder from the inlet to the outlet of the extruder. In certain embodiments, temperature of the extruder at the inlet is between about 550° F. and about 950° F. and decreases gradually along the horizontal profile to the outlet of the extruder to between about 50° F. and about 350° F. Still in other embodiments, the step of cutting consistently sized and shaped petroleum coke at the outlet of the extruder comprises the use of an automatically timed blade to cut the consistently sized and shaped petroleum coke. In some embodiments, the speed of the automatically timed blade is adjusted based on rotational speed of an extrusion screw in the extruder and residence time of the processed vacuum residue in the extruder. Still in other embodiments, the extruder includes an extrusion screw in an annulus, the extrusion screw selected from the group consisting of: a cylindrically-shaped extrusion screw and a conically-shaped extrusion screw.

In other embodiments, the step of heating the processed vacuum residue throughout a horizontal profile of the extruder from an inlet to an outlet of the extruder comprises a series of variable temperature heaters external to the extruder disposed along the horizontal profile of the extruder. In certain embodiments, the consistently sized and shaped petroleum coke is substantially circular in the cross section with a consistent depth and in the form of a puck shape. In some embodiments, the steps of heating and venting require no vacuum or vacuum distillation and coking reactions take place along the entire horizontal profile from the inlet to the outlet of the extruder. Still in other embodiments, the method does not require the application of chemical additives during processing.

Additionally disclosed herein are systems for production of consistently sized and shaped petroleum coke from vacuum residue, one system including an extrusion system, the extrusion system comprising an extruder fluidly coupled to a processed vacuum residue inlet; heating elements disposed proximate the extrusion system and along a horizontal profile of the extruder from the processed vacuum residue inlet to an outlet of the extruder; a venting zone to remove hydrocarbon off-gases from the extruder along the horizontal profile of the extruder from the processed vacuum residue inlet to the outlet of the extruder; and a cutting blade disposed proximate the outlet of the extruder for cutting consistently sized and shaped petroleum coke at the outlet of the extruder. In some embodiments, the system operates without the application of steam, hydrogen, or water. In certain embodiments, the system includes a coker fractionator operable to fractionate vacuum residue, produced in a vacuum distillation column at a temperature between about 430° C. to about 450° C. and a pressure of about 0.1 kPa, to remove liquid propane gas, fuel gas, coker naphtha, light coker gas oil, and heavy coker gas oil to produce the processed vacuum reside as a bottom product for the processed vacuum residue inlet.

In other embodiments, the venting zone vents hydrocarbon off-gases from the extruder to the coker fractionator. Still in yet other embodiments, the venting zone comprises multiple vents along the horizontal profile of the extruder from the processed vacuum residue inlet to the outlet of the extruder. In certain embodiments, temperature of the extruder at the processed vacuum residue inlet is between about 550° F. and about 950° F. and decreases gradually along the horizontal profile to the outlet of the extruder to between about 50° F. and about 350° F. Still in other embodiments, the cutting blade for cutting consistently sized and shaped petroleum coke at the outlet of the extruder comprises an automatically timed knife to cut the consistently sized and shaped petroleum coke. In some embodiments, the speed of the automatically timed knife is adjusted based on rotational speed of an extrusion screw in the extruder and residence time of the processed vacuum residue in the extruder.

In some embodiments, the extruder includes an extrusion screw in an annulus, the extrusion screw selected from the group consisting of: a cylindrically-shaped extrusion screw and a conically-shaped extrusion screw. In other embodiments, the heating elements comprise a series of variable temperature heaters external to the extruder disposed along the horizontal profile of the extruder. Still in other embodiments, the consistently sized and shaped petroleum coke is substantially circular in the cross section with a consistent depth and in the form of a puck shape. In certain embodiments, the extrusion system and venting zone require no vacuum or vacuum distillation and wherein coking reactions take place along the entire horizontal profile from the inlet to the outlet of the extruder. In yet other embodiments, the system does not require the application of chemical additives during processing.

BRIEF DESCRIPTION OF THE DRAWINGS

These and other features, aspects, and advantages of the present disclosure will become better understood with regard to the following descriptions, claims, and accompanying drawings. It is to be noted, however, that the drawings illustrate only several embodiments of the disclosure and are therefore not to be considered limiting of the disclosure's scope as it can admit to other equally effective embodiments.

DETAILED DESCRIPTION

So that the manner in which the features and advantages of the embodiments of systems of and methods of directly producing petroleum coke from vacuum residue via extrusion, as well as others, which will become apparent, may be understood in more detail, a more particular description of the embodiments of the present disclosure briefly summarized previously may be had by reference to the embodiments thereof, which are illustrated in the appended drawings, which form a part of this specification. It is to be noted, however, that the drawings illustrate only various embodiments of the disclosure and are therefore not to be considered limiting of the present disclosure's scope, as it may include other effective embodiments as well.

Figure 1:
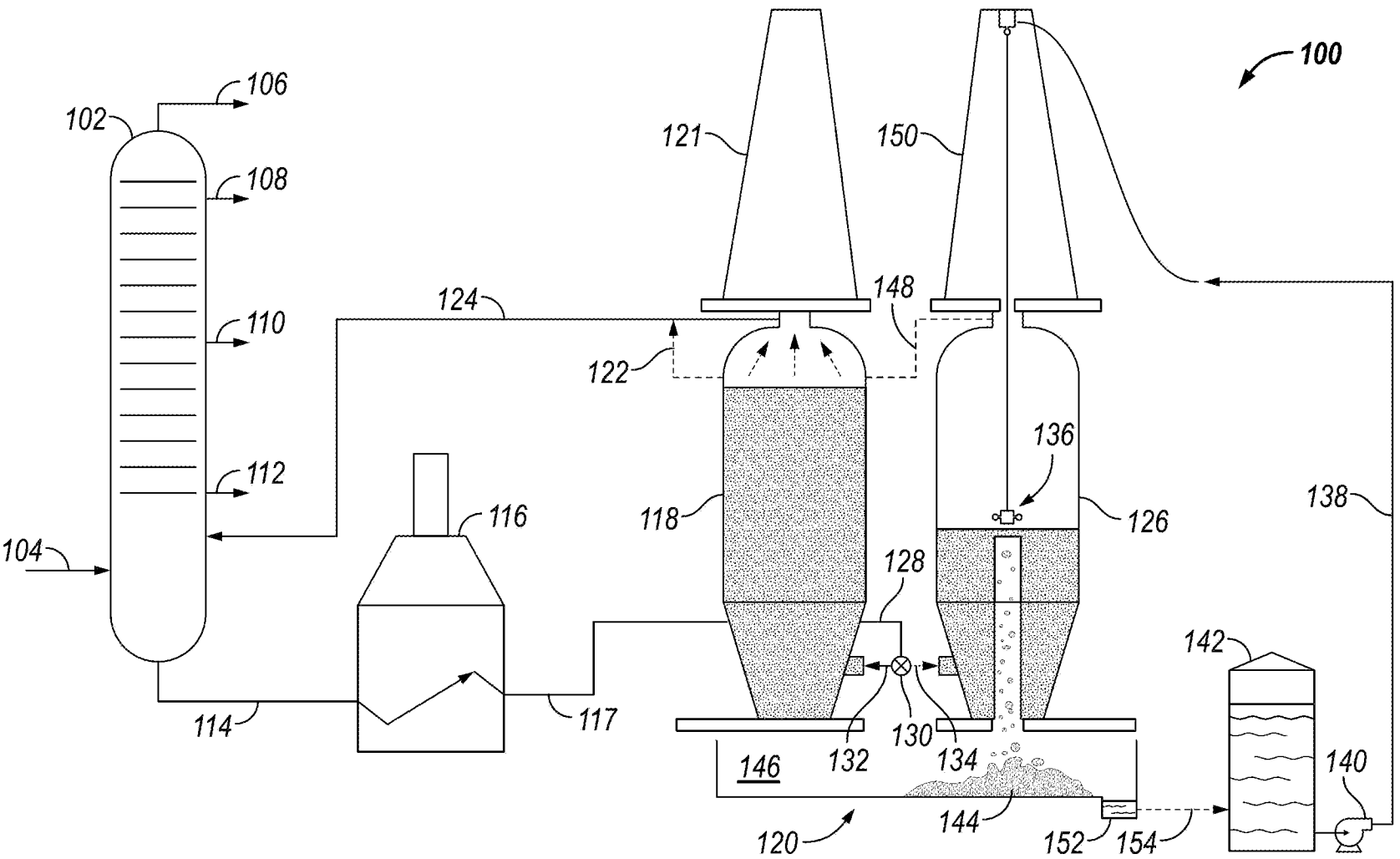
FIG. 1 (Prior Art)
FIG. 1 is a schematic diagram of a prior art system for production of petroleum coke from vacuum residue of oil refining.

FIG. 1 is a schematic diagram of a prior art system for production of petroleum coke from vacuum residue of oil refining. In prior art petroleum coke production system 100, vacuum residue produced during vacuum distillation of refining crude oil enters coker fractionator 102 via stream 104. Vacuum residue can be produced at a temperature between about 430° C. to about 450° C. and a pressure of about 0.1 kPa. Vacuum residue feed temperature to coker fractionator 102 can vary, depending in part on whether feedstock proceeds from interim storage or directly from a vacuum distillation tower. Coker fractionator 102 generally has a fractionator flash zone temperature of about 750° F., or between about 650° F. and about 950° F., or between about 750° F. and about 850° F. The pressure of coker fractionator 102 is dependent, in part, on the pressure in subsequent coking drums, discussed further infra, which can vary from about 25 to about 50 psig. Resulting overhead pressure in coker fractionator 102 can vary between 10 to 35 psig, for example.

Products that can be recovered from coker fractionator 102 include: liquid propane gas (LPG) and fuel gas (FG) for use in fuel or other products from stream 106; coker naphtha for use in other refinery units for processing into gasoline from stream 108; light coker gas oil (LCGO) from stream 110 and heavy coker gas oil (HCGO) from stream 112, which are sent elsewhere in a refinery for hydrotreating and further processing into diesel, gasoline, and other products.

Heavy bottoms stream 114 provides feed to coker furnace 116. Coker furnace 116 heats heavy liquid material from stream 114 and the bottom of coker fractionator 102 to a temperature in excess of about 900° F. (480° C.). Heating causes heavy bottoms stream 114 to crack or chemically react into a combination of smaller hydrocarbon compounds. Steam can be injected to coker furnace 116 to reduce cracking until the heavy bottoms stream 114 reaches coking drums, where cracking and coke formation are desired. Cracking in coker furnace 116 and heavy bottoms stream 114 are undesirable because this can reduce yields and require more frequent furnace de-coking.

Heated heavy bottoms product stream 117 proceeds from coker furnace 116 to first coking drum 118, in the embodiment shown the operating drum. Coker units typically include 2 or more coke drums which operate in pairs in a semi-batch mode. In first coking drum 118, heated heavy bottoms product stream 117 from coker furnace 116 (at high temperature and low pressure) is injected into the bottom of first coking drum 118 and cracked into both products which are returned to coker fractionator 102 for recovery, and petroleum coke that solidifies in the drum. All of the heat necessary for coking is provided in coker furnace 116, whereas coking, or solidification of petroleum coke and separation of hydrocarbon off-gases, takes place in the coke drum, which is why the process is commonly referred to as delayed coking.

In second coking drum 126, or the cutting drum as shown in FIG. 1, the drum is treated with steam, vented, and partially cooled prior to second coking drum 126 being opened to the atmosphere. After second coking drum 126 is opened, solid petroleum coke is cut from the drum using high pressure water. A jet water pump 140 produces high pressure water in stream 138 from water in tank 142, and high pressure water in stream 138 is fed to a rotating cutting bit 136 for cutting solidified petroleum coke product. Rotating cutting bit 136 is lowered and raised within second coking drum 126. Petroleum coke products produced in the prior art, typically referred to as coke, can be similar to coal and are commonly blended with coal and used as fuel in power industrial plants. Petroleum coke has a high fuel value and can burn much hotter than coal.

Produced, inconsistently sized and shaped, coke product and cutting water flow into coke handling system 120 with coke pit 146. Cutting water can be separated and recycled via water collection sump 152 and line 154 to tank 142. Operations are alternated between first coking drum 118 and second coking drum 126. In one drum, petroleum coke and gases are formed via cracking, while in the other drum, solidified petroleum coke is cut via water cutting. The first coking drum 118 and second coking drum 126 in FIG. 1 are interchangeable via streams 128, 132, and 134 along with controllable valve 130. Light hydrocarbon gases produced in first coking drum 118 are partially collected in venting and collection unit 121, and a portion can be recycled to coker fractionator 102 via streams 122, 124. Light hydrocarbon gases produced in second coking drum 126 are partially collected in venting and collection unit 150, and a portion can be recycled to coker fractionator 102 via streams 148, 122, and 124. Overhead products from first coking drum 118 and second coking drum 126 proceed to coker fractionator 102 where LPG and fuel gas, coker naphtha, and heating oil (LCGO and HCGO) fractions are recovered.

Generally pairs of coking drums are required so that while one drum is cracking to produce petroleum coke and hydrocarbon off-gases, the other drum is being cleaned with cutting water to allow continuous processing. Drum operation cycles can last as long as 48 h. Yields and product quality vary widely due to the broad range of feedstock types available for delayed coking units, and there is a decrease in overhead yield with increasing asphaltene content of a given feedstock.

One of many disadvantages of delayed coking systems and processes are that these are thermal cracking process, and are generally more expensive processes than solvent deasphalting. Although coke is oftentimes considered a low-value by-product, when compared to transportation fuels, there is a significant demand for consistent and efficiently-produced high-sulfur petroleum coke.

Hot hydrocarbon product vapors and steam from the top of first coking drum 118 and second coking drum 126 are quenched by incoming feed in stream 104 to coker fractionator 102 to prevent coking in the fractionator and to strip the lighter components of the vacuum residue feed.

Figure 2A:
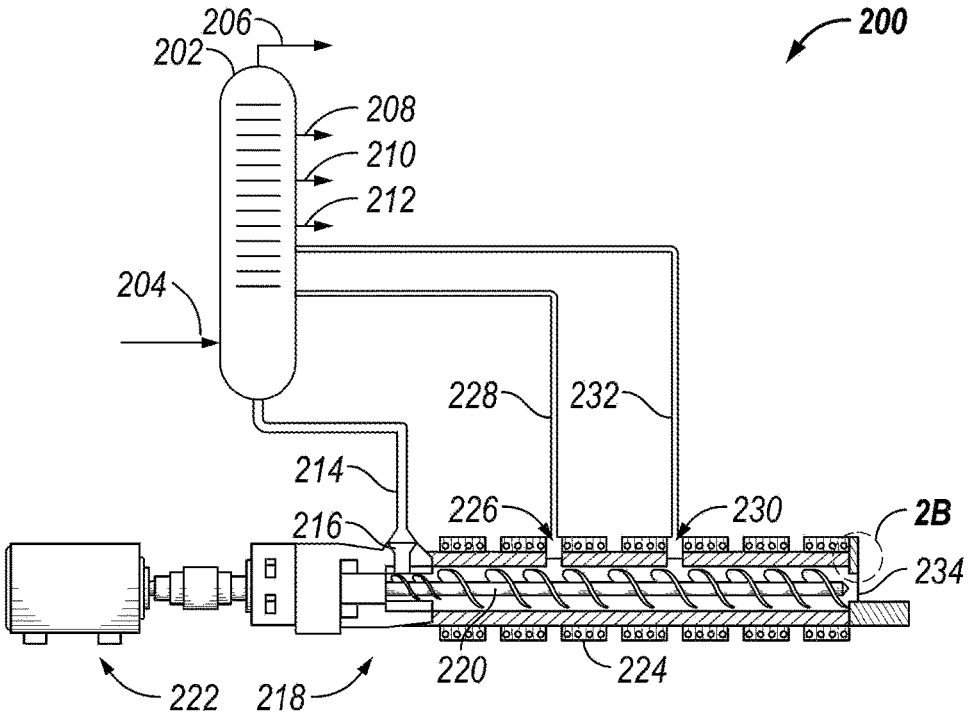
FIG. 2A is a schematic diagram of an embodiment of the present disclosure for direct production of petroleum coke from vacuum residue of oil refining using an extruder.

FIG. 2A is a schematic diagram of an embodiment of the present disclosure for direct production of petroleum coke from vacuum residue of oil refining using an extruder. In petroleum coke production system 200, vacuum residue produced during vacuum distillation of refining crude oil enters coker fractionator 202 via stream 204. Vacuum residue can be produced at temperatures between about 430° C. to about 450° C. and a pressure of about 0.1 kPa. Vacuum residue feed temperature to coker fractionator 202 can vary, depending in part on whether feedstock proceeds from interim storage or directly from a vacuum distillation tower. Coker fractionator 202 generally has a fractionator flash zone temperature of about 750° F., or between about 650° F. and about 950° F., or between about 750° F. and about 850° F. The pressure of coker fractionator 202 is dependent, in part, on the pressure in subsequent extrusion units, discussed further infra, which can vary from about 1 to about 50 psig. Resulting overhead pressure in coker fractionator 202 can vary between 10 to 35 psig, for example.

Products that can be recovered from coker fractionator 202 include: liquid propane gas (LPG) and fuel gas (FG) for use in fuel or other products from stream 206; coker naphtha for use in other refinery units for processing into gasoline from stream 208; and light coker gas oil (LCGO) from stream 210 and heavy coker gas oil (HCGO) from stream 212, which are sent elsewhere in a refinery for hydrotreating and further processing into diesel, gasoline, and other products.

Heavy bottoms stream 214 provides a coker-fractionated heavy bottom feed to extrusion system 218 via extruder inlet stream 216. Extrusion system 218 includes in the embodiment shown a cylindrically-shaped extrusion screw 220. Motor 222 controls the rotational speed of extrusion screw 220, and thereby controls the residence time of the coker-fractionated heavy bottom feed within extrusion system 218. As coker-fractionated heavy bottom feed proceeds through extrusion system 218, the temperature profile throughout is controlled by heating elements 224, for example electric or gas heating elements, which allow for controlled heating and a controlled temperature profile throughout extrusion system 218. Residence time can be varied as needed from between about 1 minute and about 1 hour or 1 day, but is surprisingly and unexpectedly less than that required in the embodiment of FIG. 1.

As the coker-fractionated heavy bottom feed proceeds through extrusion system 218, lighter hydrocarbon off-gases are removed and recycled to coker fractionator 202 through first vent 226 and gas recycle line 228 along with second vent 230 and gas recycle line 232. In one embodiment as coker-fractionated heavy bottom feed proceeds through extrusion system 218 from extruder inlet stream 216 to extruder outlet 234 with hydrocarbon off-gases being removed for recycle, the temperature profile along the horizontal width decreases from about between 650° F. and about 950° F. to between about 50° F. and about 350° F. In some embodiments, the temperature along a horizontal extruder profile is between about 350° C. (572° F.) to about 450° C. (842° F.). Pressure along the horizontal extruder profile can be between about 0.1 kPa to about 1 kPa. In one embodiment as coker-fractionated heavy bottom feed proceeds through extrusion system 218 from extruder inlet stream 216 to extruder outlet 234 with hydrocarbon off-gases being removed for recycle, coking reactions occur along the entire horizontal profile of extrusion screw 220 without vacuum being applied, without steam or hydrogen application, and without distillation or vacuum distillation. Overhead products from extrusion system 218 proceed to coker fractionator 202 where LPG and fuel gas, coker naphtha, and heating oil (LCGO and HCGO) fractions are recovered. In some embodiments, no steam, hydrogen, or chemical additives are required throughout extrusion system 218 as coking reactions occur along the entire horizontal profile of extrusion screw 220.

Figure 2B:
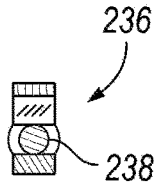
FIG. 2B is a cross section of an outlet of the schematic diagram of FIG. 2A of an embodiment of the present disclosure for direct production of petroleum coke from vacuum residue of oil refining using an extruder.

At extruder outlet 234, an auto-knife 236 (shown in inlay, FIG. 2B) cuts consistent cross-sections 238 of a cooled, solidified petroleum coke product. Advantageously, the system and process of FIG. 2 is continuous, rather than batch processes of the prior art, and also surprisingly and unexpectedly produces consistently sized and shaped petroleum coke solid for sale and use.

Figure 3A:
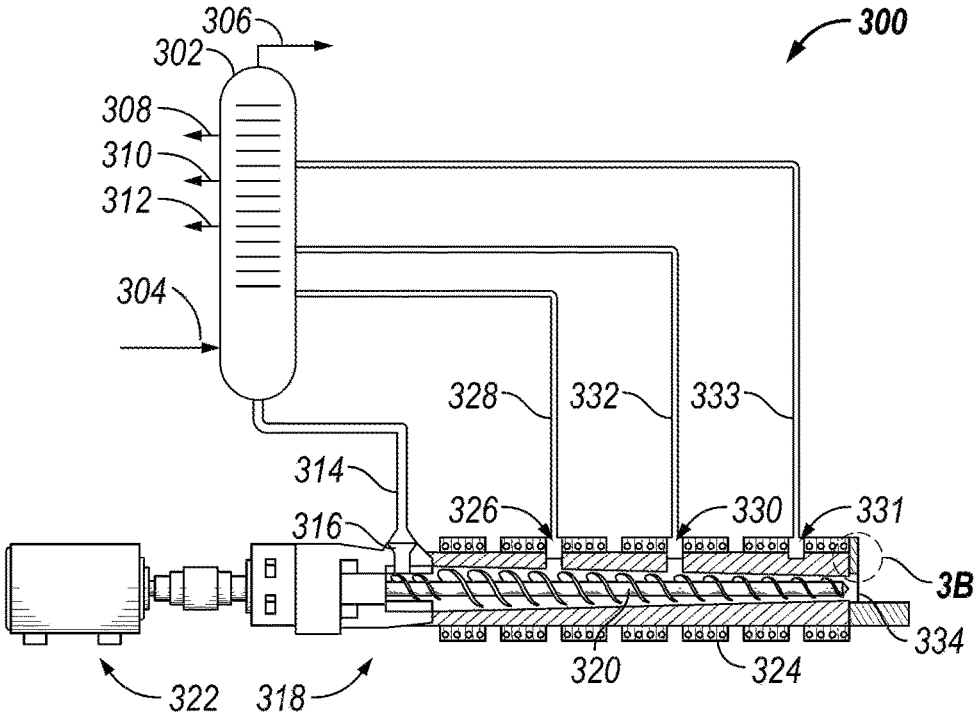
FIG. 3A is a schematic diagram of an embodiment of the present disclosure for direct production of petroleum coke from vacuum residue of oil refining using a cone-shaped extruder.

FIG. 3A is a schematic diagram of an embodiment of the present disclosure for direct production of petroleum coke from vacuum residue of oil refining using an extruder. In petroleum coke production system 300, vacuum residue produced during vacuum distillation of refining crude oil enters coker fractionator 302 via stream 304. Vacuum residue can be produced at temperatures between about 430° C. to about 450° C. and a pressure of about 0.1 kPa. Vacuum residue feed temperature to coker fractionator 302 can vary, depending in part on whether feedstock proceeds from interim storage or directly from a vacuum distillation tower. Coker fractionator 302 generally has a fractionator flash zone temperature of about 750° F., or between about 650° F. and about 850° F. The pressure of coker fractionator 202 is dependent, in part, on the pressure in subsequent extrusion units, discussed further infra, which can vary from about 1 to about 50 psig. Resulting overhead pressure in coker fractionator 202 can vary between 10 to 35 psig, for example.

Products that can be recovered from coker fractionator 302 include: liquid propane gas (LPG) and fuel gas (FG) for use in fuel or other products from stream 306; coker naphtha for use in other refinery units for processing into gasoline from stream 308; light coker gas oil (LCGO) from stream 310 and heavy coker gas oil (HCGO) from stream 312, which are sent elsewhere in a refinery for hydrotreating and further processing into diesel, gasoline, and other products.

Heavy bottoms stream 314 provides a coker-fractionated heavy bottom feed to extrusion system 318 via extruder inlet stream 316. Extrusion system 318 includes in the embodiment shown a conical-shaped extrusion screw 320 disposed in a conically-shaped annulus. Motor 322 controls the rotational speed of extrusion screw 320, and thereby controls the residence time of the coker-fractionated heavy bottom feed within extrusion system 318. As coker-fractionated heavy bottom feed proceeds through extrusion system 318, the temperature profile throughout is controlled by heating elements 324, for example gas or electric heating elements, which allow for controlled heating and a controlled horizontal temperature profile throughout extrusion system 318. Residence time can be varied as needed from between about 1 minute and about 1 hour or 1 day, but is surprisingly and unexpectedly less than that required in the embodiment of FIG. 1.

As the coker-fractionated heavy bottom feed proceeds through extrusion system 318, lighter hydrocarbon off-gases are removed and recycled to coker fractionator 302 through first vent 326 and gas recycle line 328 along with second vent 330, gas recycle line 332, vent 331, and gas recycle line 333. In one embodiment as coker-fractionated heavy bottom feed proceeds through extrusion system 318 from extruder inlet stream 316 to extruder outlet 334 with hydrocarbon off-gases being removed for recycle, the temperature profile along the horizontal width decreases from about between 650° F. and about 850° F. or 950° F. to between about 50° F. and about 350° F. Overhead products from extrusion system 318 proceed to coker fractionator 302 where LPG and fuel gas, coker naphtha, and heating oil (LCGO and HCGO) fractions are recovered.

Figure 3B:
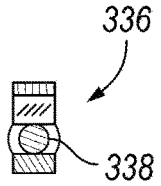
FIG. 3B is a cross section of an outlet of the schematic diagram of FIG. 3A of an embodiment of the present disclosure for direct production of petroleum coke from vacuum residue of oil refining using a cone-shaped extruder.

At extruder outlet 334, an auto-knife 336 (shown in inlay, FIG. 3B) cuts consistent cross-sections 338 of a cooled, solidified petroleum coke product. In some embodiments, as motor 322 speed is increased, increasing the rotations of extrusion screw 320 and decreasing residence time of the processed vacuum residue in the extruder, the speed of the auto-knife 336 for cutting the consistently sized and shaped petroleum coke can be increased.

Advantageously, the system and process of FIG. 3 is continuous, rather than batch processes of the prior art, and also surprisingly and unexpectedly produces consistently sized and shaped petroleum coke solid for sale and use. For example, the embodiments of FIGS. 2 and 3 can produce consistently sized and shaped petroleum coke disks or pucks, or tubular forms, substantially circular in the cross section and of varying depth based on the speed of the extruder screw and the speed of repetition of an auto-knife. Such consistently sized and shaped disks or pucks increase ease of handling and subsequent use for petroleum coke, for example as use as a fuel in steel production operations.

Embodiments of systems and methods here reduce energy consumption, downtime for maintenance, and costs associated with prior art systems and methods, and allow for consistently sized and shaped solid petroleum coke production. Notably, in some embodiments, no water or steam is required in the extrusion systems, and the systems and processes convert coker-fractionated vacuum residue to petroleum pitch without the application of steam, hydrogen, or cutting water.

Although the disclosure has been described with respect to certain features, it should be understood that the features and embodiments of the features can be combined with other features and embodiments of those features.

Although the disclosure has been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a," "an," and "the" include plural referents, unless the context clearly dictates otherwise. The term "about" in some embodiments includes values 5% above or below the value or range of values provided.

As used throughout the disclosure and in the appended claims, the words "comprise," "has," and "include" and all grammatical variations thereof are each intended to have an open, non-limiting meaning that does not exclude additional elements or steps.

As used throughout the disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

While the disclosure has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present disclosure may suitably comprise, consist or consist essentially of the elements disclosed and may be practiced in the absence of an element not disclosed.

The invention claimed is:

1. A method of production for consistently sized and shaped petroleum coke from vacuum residue, the method comprising the steps of:

fractionating vacuum residue in a coker fractionator, where the vacuum residue is produced in a vacuum distillation column at a temperature between about 430° C. to about 450° C. and a pressure of about 0.1 kPa, where fractionating the vacuum residue removes liquid propane gas, fuel gas, coker naphtha, light coker gas oil, and heavy coker gas oil to produce a processed vacuum reside, where the coker fractionator operates at a pressure between 1 psig to 50 psig and a temperature in a fractionator flash zone between 650° F. and 950° F.;

supplying the processed vacuum residue to an extruder;

heating the processed vacuum residue throughout a horizontal profile of the extruder from an inlet to an outlet of the extruder, wherein a temperature along the horizontal profile is between about 350° C. and about 450° C. and a pressure along the horizontal profile is 0.1 kPa and is consistent;

venting hydrocarbon off-gases from the extruder along the horizontal profile of the extruder from the inlet to the outlet of the extruder; and recycling the hydrocarbon off-gases to the coker fractionator; and cutting consistently sized and shaped petroleum coke at the outlet of the extruder comprises the use of an automatically timed blade to cut the consistently sized and shaped petroleum coke.

2. The method according to claim 1, wherein the method is carried out without the application of steam, hydrogen, or water.

3. The method according to claim 1, where the step of venting is carried out in multiple stages along the horizontal profile of the extruder from the inlet to the outlet of the extruder.

4. The method according to claim 1, wherein the speed of the automatically timed blade is adjusted based on rotational speed of an extrusion screw in the extruder and residence time of the processed vacuum residue in the extruder.

5. The method according to claim 1, wherein the extruder includes an extrusion screw in an annulus, the extrusion screw selected from the group consisting of: a cylindrically-shaped extrusion screw and a conically-shaped extrusion screw.

6. The method according to claim 1, wherein the step of heating the processed vacuum residue throughout a horizontal profile of the extruder from an inlet to an outlet of the extruder comprises a series of variable temperature heaters external to the extruder disposed along the horizontal profile of the extruder.

7. The method according to claim 1, wherein the consistently sized and shaped petroleum coke is substantially circular in the cross section with a consistent depth and in the form of a puck shape.

8. The method according to claim 1, wherein the steps of heating and venting require no vacuum or vacuum distillation and wherein coking reactions take place along the entire horizontal profile from the inlet to the outlet of the extruder.

9. The method according to claim 1, wherein the method does not require the application of chemical additives during processing.

10. The method of claim 1, wherein coking reactions occur along the entire horizontal profile of the extruder from the inlet to the outlet of the extruder.

* * * * *